United States Patent [19]

Brown et al.

[11] Patent Number: 4,462,464

[45] Date of Patent: Jul. 31, 1984

[54] WELLHEAD WITH HYDRAULIC PUMP ACTUATOR

[75] Inventors: Harold D. Brown, Box 518, Hutchinson, Kans. 67501; Leon J. Rohling; Mark A. Brown, both of Nickerson, Kans.

[73] Assignee: Harold D. Brown, Nickerson, Kans.

[21] Appl. No.: 327,683

[22] Filed: Dec. 4, 1981

Related U.S. Application Data

[63] Continuation of Ser. No. 214,564, Dec. 8, 1980, , which is a continuation of Ser. No. 938,215, Aug. 30, 1978, abandoned.

[51] Int. Cl.[3] ..... E21B 43/00

[52] U.S. Cl. ..... 166/68.5; 166/87; 166/372; 91/50

[58] Field of Search ..... 166/68.5, 87, 88, 89, 166/372; 285/140; 91/50

[56] References Cited

U.S. PATENT DOCUMENTS

| | | | |
|---|---|---|---|
| 1,926,856 | 9/1933 | Leman | 166/88 |
| 2,003,446 | 6/1935 | Imler et al. | 166/88 |
| 2,475,429 | 7/1949 | Hamason | 166/88 |
| 2,869,469 | 1/1959 | Williams | 166/68.5 |
| 2,874,641 | 7/1959 | McCandlish et al. | 166/68.5 |
| 3,212,406 | 10/1965 | McDuffie | 166/68.5 |
| 3,643,432 | 2/1972 | Klaeger | 91/50 |

*Primary Examiner*—Stephen J. Novosad
*Assistant Examiner*—William P. Neuder
*Attorney, Agent, or Firm*—D. A. N. Chase; Michael Yakimo, Jr.

[57] ABSTRACT

A wellhead assembly especially suited for oil wells has a wide working pressure range and employs three components which fit together to seal the well casing, hold the tubing against high wellhead pressures, and provide a connection to the tubing through which the sucker rods are operated. The primary casing seal is formed by the mating contact of metal surfaces that are not subject to deterioration. The actuator for the subsurface pump is a vertically disposed hydraulic cylinder unit aligned with the sucker rods and forming the uppermost section of an elongated cylindrical housing, which also has a lowermost section on the wellhead that provides the outlets for the fluid pumped from the well, and an intermediate, control section that contains a spool valve for controlling the hydraulic actuator. The spool is shifted by the piston and rod of the hydraulic actuator at the upper and lower limits of their stroke to thereby reciprocate the sucker rods and operate the subsurface pump.

14 Claims, 8 Drawing Figures

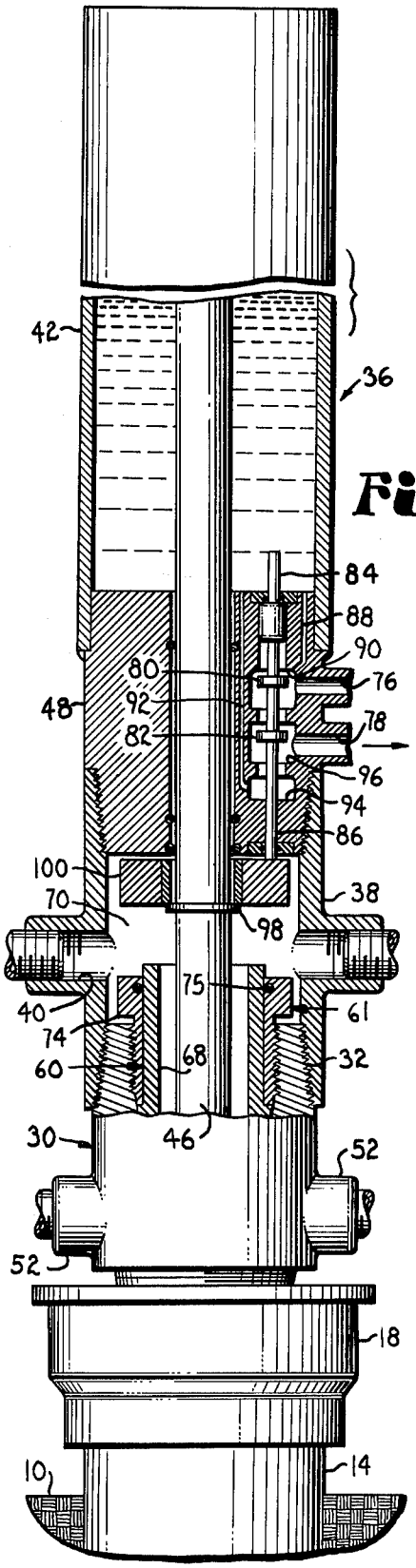
Fig. 3.
Fig. 4.
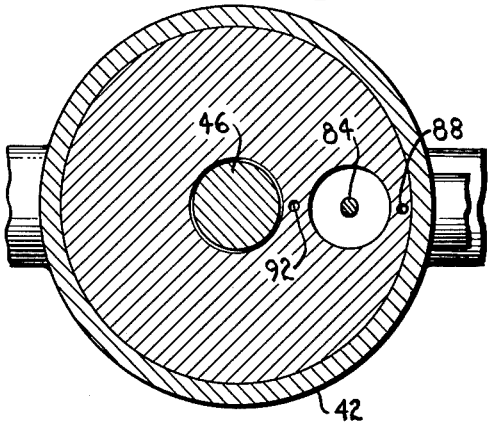
Fig. 5.
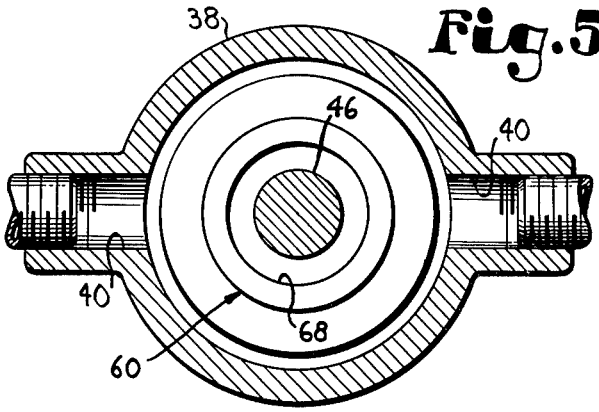
Fig. 6.
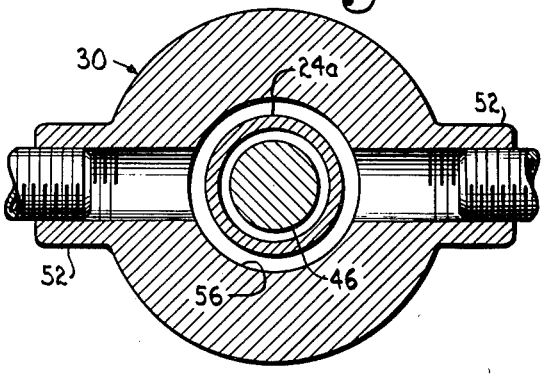

Fig. 7.
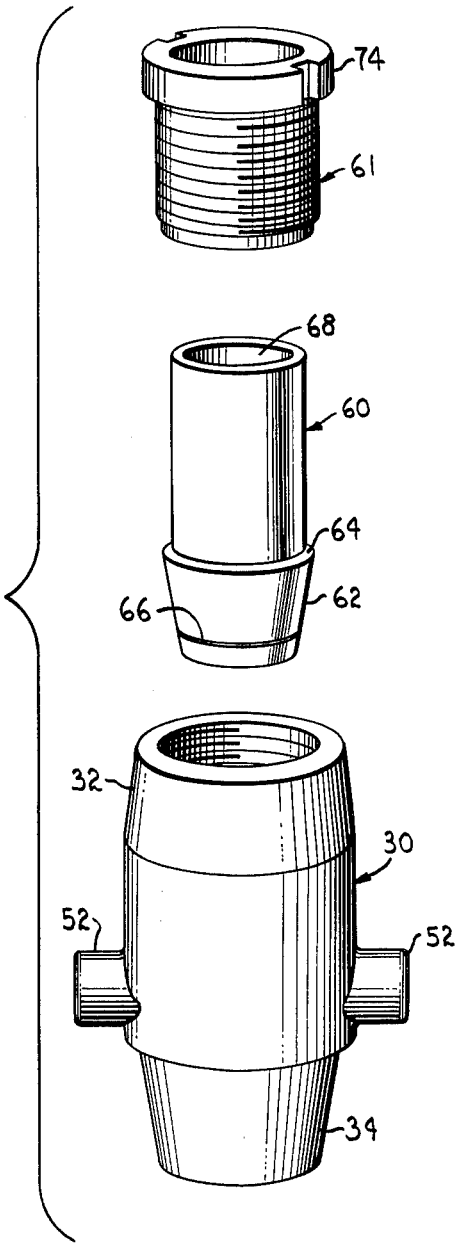
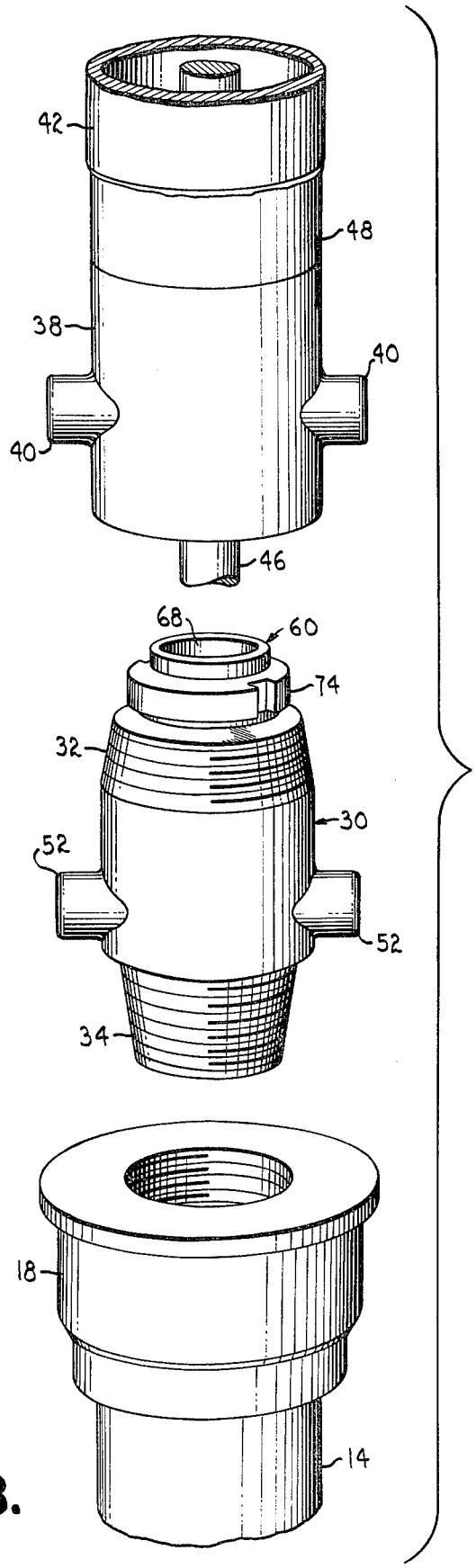
Fig. 8.

WELLHEAD WITH HYDRAULIC PUMP ACTUATOR

This application is a continuation of application Ser. No. 214,564, filed 12/8/80, which, in turn, is a continuation of application Ser. No. 938,215, filed 8/30/78 (now abandoned).

This invention relates to improvements in wellheads of the type used in the recovery of oil and, more particularly, to a relatively uncomplex but highly effective wellhead assembly capable of withstanding high working pressures, and to an inline hydraulic cylinder operating through the wellhead for actuating a subsurface pump.

Wellheads employed in crude oil recovery provide the necessary outlets for wellhead gas and fluid, and serve to maintain the well tubing sealed from the casing while permitting the sucker rods within the tubing to be reciprocated by a pump jack or other suitable type of pump actuator. Wellheads are commercially available in various configurations and are rated as to working pressure. One common and widely used type employs segmented slips to grip and hold the tubing, and rubber ring headsets form a seal over the casing to maintain the necessary isolation. Although wellhead assemblies of this type are satisfactory and in widespread use, they are undesirably complex due to the number of parts involved and the headsets are subject to deterioration by expansion and rotting.

The function of the tubing is to provide a passage for the fluid pumped from the production zone, and the pony rods and sucker rods that operate the subsurface pump are housed within the tubing and reciprocated therein by a pump actuator at the ground surface well site. Commonly, as mentioned above, a pump jack is employed for this purpose and is powered by an electric motor or internal combustion engine. Though pump jacks have been employed for years in oil production, their inherent weight and complexity make this type of pump actuator less than optimum for use at remote locations where in some instances the production equipment is shipped to the well site by aircraft. Additionally, the pump jack has relatively high power loss in the gearing or belt drives employed to transmit power from the prime mover to the crank.

It is, therefore, an important object of the present invention to provide a wellhead assembly which overcomes the disadvantages discussed above.

As a corollary to the foregoing object, it is an important aim of this invention to provide a wellhead assembly as aforesaid having a minimum number of parts and which may be simply and easily installed on the well casing and tubing.

Still another important object of the invention is to provide a wellhead assembly which does not require sets of sealing rings in order to effectively seal the well casing, and where the primary seal is formed by surface-to-surface contact of metal components that are not subject to deterioration.

Still another important object of the invention is to provide a wellhead assembly as aforesaid in which a single unit has a wide working pressure range, with a capability in such unit of accommodating wells where high gas pressures may be encountered.

Yet another important object is to provide such a wellhead assembly which, by virtue of its simplicity as aforesaid, is both low in cost and highly reliable.

Furthermore, it is an important objective of this invention to provide a pump actuator which is significantly lower in cost, simpler and more efficient than pump jacks in order to overcome their inherent disadvantages discussed above.

As a corollary to the immediately preceding object, it is an important aim of this invention to provide a pump actuator as aforesaid which is light in weight and thus may be readily transported to the well site by aircraft.

Another important object of this invention is to provide a pump actuator as aforesaid having few moving parts and a long operating life.

Still another important object of the invention is to provide a pump actuator that is especially suited for high fluid oil wells where a high volume of fluid must be pumped for significant oil recovery.

Yet another important object is to provide such a pump actuator which is operated by a hydraulic source in order to maximize efficiency through the elimination of friction loss and slippage inherent in gear and belt drives.

DESCRIPTION OF THE DRAWINGS

FIG. 3 is a view similar to FIG. 2 but shows the piston in a different position;

FIG. 4 is an enlarged, horizontal sectional view taken along line 4—4 of FIG. 2 and shows the upper end of the spool of the control valve;

FIG. 5 is an enlarged, horizontal sectional view taken along line 5—5 of FIG. 2 and shows the upper end of the wellhead assembly;

FIG. 6 is an enlarged, horizontal sectional view of the wellhead taken along line 6—6 of FIG. 2;

FIG. 7 is an exploded view of the wellhead assembly showing the three components thereof; and FIG. 8 is an exploded view showing the components of FIG. 7 fully assembled, and their relationship to the pipe collar on the casing (below) and the fluid outlet section of the cylinder (above).

DETAILED DESCRIPTION

Figure 1:
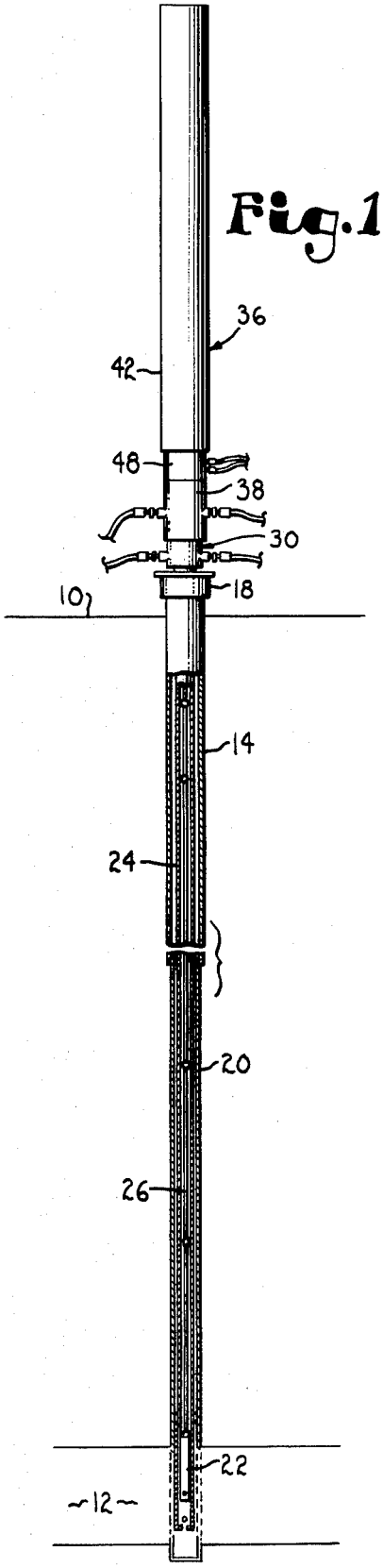
FIG. 1 is an elevational view of the wellhead and in-line cylinder actuator of the present invention, subsurface features of the usual oil well casing and associated components being revealed diagrammatically and in longitudinal cross-section.
Figure 2:
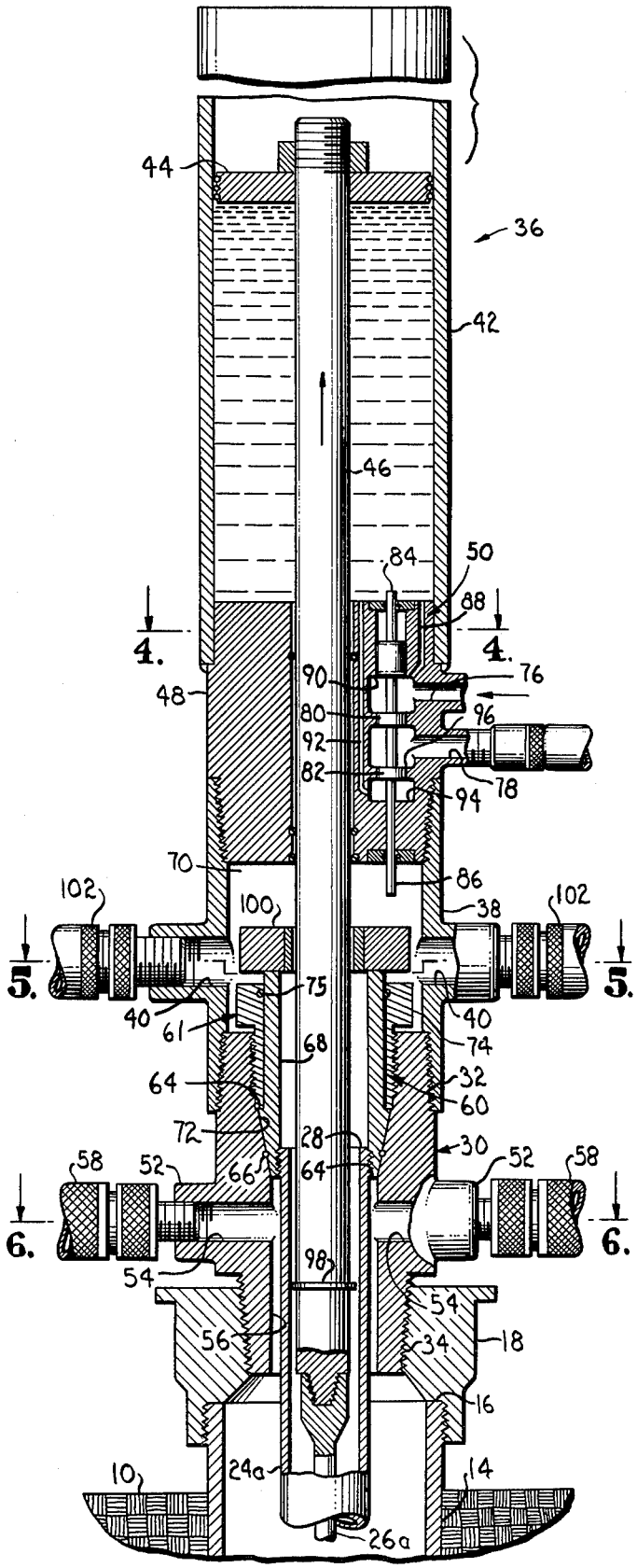
FIG. 2 is a fragmentary, longitudinal, vertical sectional view of the wellhead and cylinder with certain parts being shown in elevation for clarity.

Referring initially to FIGS. 1 and 2, the surface of the ground at a well site is represented at 10 and the subsurface production zone is diagrammatically illustrated at 12. A surface casing 14 has an upper terminal end 16 just above the ground surface 10, and a pipe collar 18 is threaded thereon as is clear in FIG. 2. The production casing 20 extends from surface casing 14 to the production zone 12, and a subsurface pump is diagrammatically illustrated at 22. The pump 22 is reciprocated within well tubing 24 and is operated by sucker rods 26. The uppermost sucker rod **26*a* is partially shown in FIG. 2 within the uppermost tube 24*a* that presents the upper terminal end 28 of the tubing 24**.

A wellhead assembly having a tubular body 30 is mounted on the pipe collar 18 and has two additional components to be described below. At this juncture, it should be noted that the body 30 has opposed, upper and lower ends 32 and 34 respectively, each of which is provided with external pipe threads. The lower end 34 is threadably received in a central opening in the pipe collar 18, whereas the upper end 32 is threadably received within the lower end of an elongated, vertically disposed, cylindrical housing broadly denoted by the numeral 36. Accordingly, the cylindrical housing 36 is mounted atop the wellhead body 30 and has three functions. First, the housing 36 has a lowermost section 38 that provides a pair of diametrically opposed outlets 40 for the fluid pumped from the well through the tubing 24. Secondly, housing 36 has an uppermost section 42 which contains a single-acting hydraulic piston and cylinder unit having the usual piston 44 provided with a downwardly extending piston rod 46 connected to the subsurface pump 22 by the sucker rods 26. Thirdly, an intermediate, control section 48 between sections 38 and 42 houses a control valve 50 which governs the operation of the hydraulic piston and cylinder unit.

Referring particularly to FIGS. 2, 3 and 5–8, the body 30 is provided with a pair of diametrically opposed bosses 52 that present lateral outlets 54 for natural gas escaping from the well via the casing 14. A central passage 56 extends vertically through the body 30 from end to end and tube 24*a* is telescoped thereinto as shown in FIG. 2. The outlets 54 communicate with the passage 56, and the diameter of the passage 56 is larger than the outside diameter of the tube 24*a* so as to place the outlets 54 in communication with the interior of the casing 14. Suitable couplings 58 on the bosses 52 connect the gas outlets 54 with hoses or pipes as desired.

Besides the body 30, the wellhead assembly has two additional components best shown in the exploded view of FIG. 7. Such components comprise a sealing sleeve 60 and a retaining collar 61. The sleeve 60 has a tapered nose 62 that presents a frustoconical outer surface, and is somewhat larger in diameter at the beginning of the nose in order to define an annular shoulder 64 which extends radially outwardly from the remaining, uniformly cylindrical portion of the sleeve above the nose 62. An O-ring 66 is held in a circular groove near the tip of the nose 62 and, as may be seen in FIG. 2, the nose 62 is internally threaded adjacent the tip thereof. The sleeve 60 has a vertically extending internal bore 68 through which the lower end portion of piston rod 46 passes with appropriate clearance.

The piston rod 46 acts along a vertical axis and extends downwardly from the bore 68 into the tube 24*a* and is connected with the uppermost sucker rod 26*a*. The upper terminal end 28 of tube 24*a* is externally threaded and received by the internal threads at the lower end of the bore 68. Accordingly, the bore 68 of sleeve 60 is effectively an upward continuation of tube 24*a*, fluid pumped therefrom being discharged into a chamber 70 within the lowermost cylindrical section 38 of the vertically extending housing 36.

Above the outlets 54 in body 30, the vertical passage 56 has a frustoconical internal surface 72 presenting a downwardly tapered segment of the passage 56 that merges with the remaining, uniformly cylindrical portion thereof below the surface 72. The frustoconical taper of the surface 72 corresponds to the taper of the external surface presented by the nose 62 of sleeve 60, thereby providing mating, surface-to-surface contact to seal the passage 56 above the outlets 54. The O-ring 66 serves as a back-up seal.

The upper end 32 of the tubular body 30 is internally threaded above the surface 72 and receives mating external threads on the retaining collar 61 which is telescoped over the sleeve 60. Once threaded in place, the lower end of the collar 61 bears against the annular shoulder 64 on the sleeve 60 to hold the sleeve in the body 30 and maintain the mating frustoconical surfaces in sealing contact. The upper end of the collar 61 is provided with a circumferential flange 74 adapted to receive a wrench or other suitable tool (not shown) for the purpose of rotating the collar 61 into tight engagement with the shoulder 64. An O-ring 75 is seated around the internal bore of collar 61 just within the upper end thereof and serves as a dirt seal between collar 61 and the sleeve 60.

Referring particularly to FIGS. 2–4, the control section 48 of the cylindrical housing 36 is provided with a supply port 76 and a discharge port 78 to which appropriate connections are made from a hydraulic source (not shown). Such ports 76 and 78 are in communication with the control valve 50 which is provided with a shiftable control element or spool having a pair of spaced, upper and lower lands 80 and 82 respectively. Vertical stems 84 and 86 are axially aligned and extend from the upper and lower ends of the spool respectively and define the axis of shifting movement of the spool between two positions, one shown in FIG. 2 and the other shown in FIG. 3. Note that the upper stem 84 extends into the interior of the hydraulic cylinder formed by the uppermost housing section 42, and the lower stem 86 projects into the fluid chamber 70 in the lowermost housing section 38. A passage 88 for hydraulic fluid under pressure communicates an upper cavity 90 of valve 50 with the hydraulic cylinder, and a bleed passage 92 communicates the cylinder with a lower cavity 94. A central cavity 96 in the valve 50 is aligned with the discharge port 78, whereas the upper cavity 90 is aligned with the supply port 76.

A snap ring 98 is located on the piston rod 46 adjacent its end where it connects to sucker rod 26*a*. The piston rod 46 extends through a floating spacer collar 100 in fluid chamber 70, adequate clearance being provided between rod 46 and collar 100 to prevent interference. Fluid pumped from the well is permitted to flow from bore 68 beneath the floating collar 100 as the latter rises under fluid pressure, and thence through the outlets 40. Fittings 102 connect the outlets 40 to suitable hoses or pipes leading to the storage facility.

In operation, it may be appreciated that the wellhead assembly comprising tubular body 30, sealing sleeve 60, and retaining collar 61 may be easily installed on the well casing. Installation begins with the body 30 whose lower end 34 is threaded into the pipe collar 18, followed by installation of the sleeve 60 and the retaining collar 61. Once the collar 61 is tightened into place with its lower end engaging the annular shoulder 64, the sealing sleeve 60 (and hence the tubing 24) is positively held and retained against high pressures that may exist at the wellhead. The well casing is sealed primarily by the direct metal-to-metal contact of the frustoconical outer surface of the nose 62 in mating engagement with the internal surface 72 within the body 30.

Operation of the hydraulic pump actuator is likewise simple and straightforward. The valve spool is shown in FIG. 2 in its lower position corresponding to upward movement of the piston 44 under the pressure of the hydraulic fluid (represented by the arrow at the supply port 76). At this time the hydraulic fluid flows into the valve cavity 90 and upwardly along the passage 88 into the cylinder. The lands 80 and 82 isolate the center cavity 96 so that the fluid under pressure cannot flow downwardly from cavity 90 to the discharge port 78, nor can fluid bleed from the lower cavity 94 into cavity 96.

In FIG. 3 the valve spool is shown in its upper position at the instant it is completely actuated by engagement of the floating collar 100 with the lower stem 86. This corresponds to the upper limit of the path of travel of the piston 44 and rod 46. At this time the snap ring 98 has engaged the underside of collar 100 and has carried it upwardly as shown to shift the valve spool to the upper position. The supply and discharge ports 76 and 78 are now in communication since land 80 no longer blocks fluid flow from the upper cavity 90 to the center cavity 96. Also, the lower land 82 no longer blocks the lower cavity 94; thus hydraulic fluid is permitted to bleed from the passage 92 through cavities 94 and 96 to the discharge port 78. Accordingly, the piston 44 and rod 46 fall under the influence of gravity due to the weight of the sucker rods 26. At the lower limit of its stroke, the piston 44 strikes the upper stem 84 of the valve spool and depresses it to shift the spool to the lower position thereof shown in FIG. 2, and the piston is again raised by hydraulic pressure to repeat the cycle.

Having thus described the invention, what is claimed as new and desired to be secured by Letters Patent is:

1. In combination with a wellhead into which the tubing of a well extends:

an upright, elongated, cylindrical housing on said wellhead having a lowermost, fluid outlet section secured to the wellhead, an uppermost, pump actuator section, and an intermediate, control section between said lowermost and uppermost sections.

said lowermost section having a fluid-receiving chamber therein communicating with said tubing, and fluid outlet means communicating with said chamber, said uppermost section having a hydraulic piston and cylinder unit therein provided with a downwardly extending, reciprocable piston rod, said intermediate section having a control valve therein and hydraulic supply and discharge ports for operating said unit, said valve being provided with a control element having upper and lower ends and shiftable upwardly and downwardly between a lower position causing upward movement of said piston rod under hydraulic pressure, and an upper position relieving hydraulic pressure to permit the piston rod to fall by gravity, said piston rod extending through said intermediate section, into said chamber, and into said tubing for connection to a subsurface pump, said rod having valve actuating means thereon for engaging the lower end of said control element to shift the same from the lower to the upper position thereof when the rod reaches the upper limit of its path of travel, and for engaging the upper end of said control element to shift the same from the upper to the lower position thereof when the rod reaches the lower limit of its path of travel, whereby the piston rod reciprocates to operate the pump.

2. The combination as claimed in claim 1, wherein said upper and lower ends of the control element extend into said uppermost and lowermost sections respectively, said valve actuating means including means in said uppermost section engageable with said upper end and means in said lowermost section engageable with said lower end.

3. The combination as claimed in claim 2, wherein the piston of said unit constitutes said valve actuating means in said uppermost section engageable with said upper end of the control element.

4. The combination as claimed in claim 2, wherein said valve actuating means in said lowermost section includes a floating collar in said chamber on said rod engageable with said lower end of the control element upon upward movement of the collar, there being means carried by said rod for engaging said collar to shift the same upwardly and thereby actuate the control element.

5. In a well having a casing and a tube within the casing through which fluid in the well flows to the ground surface, said casing and said tube having upper terminal ends at or near the ground surface, the combination with said casing and tube of:

an upright, tubular body over said terminal end of the casing and having opposed, upper and lower ends and a central passage communicating with the casing and into which said terminal end of the tube extends through said lower end of the body;

means on said lower end securing the body to the casing, said body having lateral outlet means communicating with said passage, and being provided with an internal surface thereabove presenting a downwardly tapered segment of said passage;

a unitary sealing sleeve received within said upper end of the body and having a lower tip secured to said terminal end of the tube, said sleeve presenting a fluid-carrying bore aligned with said tube and communicating therewith at said tip, and being provided with a tapered portion having an outer surface in mating, surface-to-surface contact with said internal surface of the body to seal said passage;

means on said sleeve presenting a shoulder above said portion;

a retaining collar disposed in relatively telescoped relationship with said sleeve, secured to said upper end of the body, and engaging said shoulder to hold said sleeve in the body and maintain said surfaces in said mating contact, said body, sleeve and collar providing a three-component wellhead assembly for sealing the casing and holding the tube; and means on said assembly having a passage for receiving fluid from said bore flowing upwardly therethrough, and fluid outlet means communicating with said passage for flow of said fluid therefrom.

6. The combination as claimed in claim 5, wherein said shoulder is annular.

7. The combination as claimed in claim 6, wherein said sleeve has a tapered nose presenting said tapered portion, said nose being enlarged in diameter at its beginning to define said shoulder.

8. The combination as claimed in claim 5, wherein said sleeve has a tapered nose presenting said tapered portion and presenting said tip engaging said terminal end of the tube.

9. The combination as claimed in claim 8, wherein is provided thread means on said tip of the nose connecting the same to said terminal end of the tube with said bore and said tube in coaxial alignment.

10. The combination as claimed in claim 8, wherein said internal surface of the body and said outer surface presented by said nose are of frustoconical configuration.

11. The combination as claimed in claim 10, wherein said nose has a circumferential groove therein receiving an O-ring, the latter providing a back-up seal.

12. The combination as claimed in claim 8, wherein said shoulder is annular and said nose is enlarged in diameter at its beginning to define said shoulder.

13. The combination as claimed in claim 5, wherein said retaining collar is telescoped over said sleeve and secured by threads to said upper end of the body.

14. In a well having a casing and a tube within the casing through which fluid in the well flows to the ground surface, said casing and said tube having upper terminal ends at or near the ground surface, the combination with said casing and tube of:

an upright, tubular body over said terminal end of the casing and having opposed, upper and lower ends and a central passage communicating with the casing and into which said terminal end of the tube extends through said lower end of the body;

means on said lower end securing the body to the casing, said body having lateral outlet means communicating with said passage, and being provided with an internal surface thereabove presenting a downwardly tapered segment of said passage;

a unitary sealing sleeve received within said upper end of the body and provided with a tapered portion having an outer surface in mating, surface-to-surface contact with said internal surface of the body to seal said passage, said sleeve engaging said terminal end of the tube and presenting a fluid-carrying bore aligned with said tube and communicating therewith;

means on said sleeve presenting a shoulder above said portion;

a retaining collar disposed in relatively telescoped relationship with said sleeve, secured to said upper end of the body, and engaging said shoulder to hold said sleeve in the body and maintain said surfaces in said mating contact, whereby the body, sleeve and collar comprise a wellhead assembly; and an upright, elongated, cylindrical housing on said body having a lowermost, fluid outlet section secured to said upper end thereof, an uppermost, pump actuator section, and an intermediate, control section between said lowermost and uppermost sections, said lowermost section having a fluid-receiving chamber therein communicating with said bore, and fluid outlet means communicating with said chamber, said uppermost section having a hydraulic piston and cylinder unit therein provided with a downwardly extending, reciprocable piston rod, said intermediate section having a control valve therein and hydraulic supply and discharge ports for operating said unit, said valve being provided with a control element having upper and lower ends and shiftable upwardly and downwardly between a lower position causing upward movement of said piston rod under hydraulic pressure, and an upper position relieving hydraulic pressure to permit the piston rod to fall by gravity, said piston rod extending through said intermediate section, into said chamber, through said bore and into said tube for connection to a subsurface pump, said rod having valve actuating means thereon for engaging the lower end of said control element to shift the same from the lower to the upper position thereof when the rod reaches the upper limit of its path of travel, and for engaging the upper end of said control element to shift the same from the upper to the lower position thereof when the rod reaches the lower limit of its path of travel, whereby the piston rod reciprocates to operate the pump.

* * * * *